US006257149B1

(12) United States Patent
Cesaroni

(10) Patent No.: US 6,257,149 B1
(45) Date of Patent: Jul. 10, 2001

(54) LEAD-FREE BULLET

(75) Inventor: Anthony J. Cesaroni, Unionville (CA)

(73) Assignee: Cesaroni Technology, Inc. (CA)

( * ) Notice: Subject to any disclaimer, the term of this patent is extended or adjusted under 35 U.S.C. 154(b) by 0 days.

(21) Appl. No.: 09/101,844

(22) PCT Filed: Apr. 3, 1997

(86) PCT No.: PCT/CA97/00212

§ 371 Date: Oct. 5, 1998

§ 102(e) Date: Oct. 5, 1998

(87) PCT Pub. No.: WO97/38282

PCT Pub. Date: Oct. 16, 1997

(30) Foreign Application Priority Data

Apr. 3, 1996 (GB) ..... 96070222

(51) Int. Cl.[7] ..... F42B 10/00
(52) U.S. Cl. ..... 102/515; 102/517
(58) Field of Search ..... 102/514, 515, 102/516, 517; 264/267, 296

(56) References Cited

U.S. PATENT DOCUMENTS 4,517,898 * 5/1985 Davis et al. ..... 102/514
4,607,573 * 8/1986 Thureson et al. ..... 102/275.8
5,399,187 * 3/1995 Mravic et al. ..... 75/228
5,496,918 * 3/1996 Khanna et al. ..... 528/480
5,597,973 * 1/1997 Gladden et al. ..... 102/289
5,616,642 * 4/1997 West et al. ..... 524/439
5,730,664 * 3/1998 Asakura et al. ..... 473/373
5,747,722 * 5/1998 Gladden et al. ..... 102/275.11
5,837,924 * 11/1998 Austin ..... 102/275.8

FOREIGN PATENT DOCUMENTS

WO 92/08097 5/1992 (WO) ..... 12/74
WO 95/08748 3/1995 (WO) ..... 12/74

* cited by examiner

*Primary Examiner*—Michael J. Carone
*Assistant Examiner*—Aileen J. Baker
(74) *Attorney, Agent, or Firm*—Gifford, Krass, Groh, Sprinkle, Anderson & Citkowski, P.C.

(57) ABSTRACT

A bullet that will retain markings from a firearm barrel when fired from such firearm. The bullet comprises a right cylindrical core with opposed ends, one such opposed end having a tapered section integrally connected thereto. The core is formed from a lead-free composition of a polymer and filler and selectively retains it's integrity when fired from the firearm or is frangible. The right cylindrical core has a jacket that is cylindrical and formed from a thermoplastic polymer or copper. The thermoplastic polymer has a softening point above firearm barrel temperatures.

21 Claims, 3 Drawing Sheets

LEAD-FREE BULLET

The present invention relates to a bullet, and in particular to a lead-free bullet that will retain the markings of the barrel of a firearm after the bullet is fired from the firearm. As used herein, a "firearm" is intended to include rifles, pistols, guns and the like.

Firearms are used in a wide variety of ways, including hunting and other sporting activities, law enforcement activities and military activities. In hunting activities, spent bullets or parts of spent bullets remain in the environment. They may be eaten by game, or other animals or birds, either inadvertently or out of curiosity. This can cause poisoning effects, depending on the type of bullet. In addition, if the bullet is a frangible bullet, parts of the bullet will be scattered through the flesh of the game on impact, posing a potential danger to humans if the flesh is eaten or result in poisoning of the injured animal and the likelihood of a slow death. If the bullets contain lead, such poisoning and environmental effects pose significant concerns about health issues, and have resulted in governmental regulations banning the use of lead in such bullets.

In sporting activities and other testing of bullets e.g. in the firing of firearms at a firing range, lead-containing bullets are a health hazard in that fumes of lead are dispersed into the atmosphere on impact of the bullet on the target or wood or other material behind the target. The resultant haze is hazardous to the health of persons using the firing range, or employed in the firing range, and restrictions may be required on the amount of time that may be spent by a person at or on a firing range. Thus, even though bullets may be collected from a firing range in order that the materials from which the bullets are formed may be recycled, fumes from lead-containing bullets are a major health hazard.

In law enforcement activities, there is a need to be able to relate fragments of a bullet found at a crime scene to the firearm that was used to fire the bullet. Such a correlation is often important evidence in obtaining a conviction. The barrel of a firearm imparts markings to the outside of a bullet in the form of scratches, barrel rifling pattern or other marks, effectively a signature of the firearm. It is this signature that can be used in law enforcement to identify the firearm that was used to fire a particular bullet. However, to do so, it is essential that the bullet be capable of accepting and retaining such markings. This must occur even if the bullet is frangible, in which case law enforcement authorities must work with only particles or fragments of the bullet.

In military activities, bullets must be capable of being used in rapid-firing firearms, without causing jamming of the firearm during use.

Bullets may be categorized as being frangible bullets or non-frangible bullets. The latter may substantially retain their shape on impact or become distorted in shape on impact without fragmentation. Frangible bullets are intended to break apart on impact.

Some firearms are reloaded by mechanical means, for instance the use of a bolt action to eject the shell of a spent bullet and insert a new bullet into the firing chamber of the firearm. For firearms that are reloaded by such mechanical means, the weight of the bullet has little significant bearing on the reloading of the firearm. However, other firearms are automatic firearms, in which case the firing of one bullet actuates mechanisms for ejection of the spent shell and insertion of the next bullet into the firing chamber, often in a very rapid manner. Such mechanisms may, for instance, be actuated directly by pressure generated from the barrel or gas activated using gas obtained from the barrel. In both cases, the weight of the bullet must be sufficient to create a pressure within the barrel during the firing of the bullet that is sufficient to actuate the mechanisms for ejection of the shell and insertion of the next bullet into the firing chamber.

After the firing of a bullet in a firearm having an automatic reloading mechanism, the next round is inserted into the firing chamber pending the next firing of a further bullet. In rapid-firing firearms, the barrel of the firearm may become very hot, depending in particular on the number of bullets fired in a sequence, and consequently the bullet loaded into the firing chamber may become hot. Thus, bullets intended for rapid-firing firearms must have properties that will withstand the temperatures to which the bullet might be subjected in the firing chamber, without softening of any casing, fragmentation of a non-frangible bullet or other deleterious effects that might cause malfunctioning of the firearm, poor trajectory of the bullet or other problems.

Lead-free bullets are known. For instance, U.S. Pat. No. 5,399,187 discloses a bullet formed from tungsten, or an alloy of tungsten, and phenol formaldehyde or polymethylmethacrylate polymers. U.S. Pat. No. 5,012,743 discloses a light weight elongated projectile formed from a casing of copper alloy, steel or similar material and a lower density core e.g. polycarbonate or polyamide. WO 95/23952 discloses a projectile having a core of polyethylene and iron. DE-U-9209598 discloses a bullet formed from a plastic viz. polypropylene homopolymer, and a metal jacket. U.S. Pat. No. 4,503,777 discloses a lead bullet manufactured by the pouring of lead. Projectiles formed from bismuth alloys are disclosed in WO 92/08097 and WO 95/08748.

Bullets that are free of lead are strongly preferred both for environmental and health reasons, and in many instances are required by governmental regulations. Thus, there is a need for lead-free bullets, and especially for such bullets that will retain the signature of a barrel on firing. Such bullets have now been found.

Accordingly, one aspect of the present invention provides a bullet that will retain markings from a firearm barrel when fired from such firearm, comprising:

a right cylindrical core with opposed ends, one such opposed end having a tapered section integrally connected thereto, said core being formed from a lead-free composition comprising a polymer selected from amorphous or low crystallinity polymer, said composition retaining it's integrity when fired from the firearm, said right cylindrical core having a jacket that is cylindrical and formed from a thermoplastic polymer or copper, said thermoplastic polymer having a softening point above firearm barrel temperatures, said bullet preferably having a weight that is at least 80% of the weight of a comparable lead bullet.

In preferred embodiments of the invention, the adhesion between the jacket and the core is sufficient to retain the integrity of the bullet on firing until impact, preferably being such that the jacket and core separate on impact.

In another embodiment, the polymer of the core is selected from ethylene/methacrylic acid copolymer ionomers, polyetherester elastomers and polyamides.

In yet another embodiment, the mass of the bullet is sufficient to actuate firearm reloading mechanisms.

In other embodiments, the tapered section is a truncated cone, parabolic or rounded, including such shapes having a so-called "hollow point".

In a further embodiment, the jacket of the bullet extends over the tapered section attached to one end of the right cylindrical core.

In a still further embodiment, the other of the opposed ends is a truncated tapered section.

In a preferred embodiment, the jacket at the other end of the opposed ends is curled inward towards the tip, especially with the remainder of said end being free of jacket.

In another aspect of the invention there is provided a bullet in a shell, said bullet comprising a right cylindrical core with opposed ends, one such opposed end having a tapered section integrally connected thereto, said core being formed from a lead-free composition comprising a polymer selected from amorphous or low crystallinity polymer, said composition retaining it's integrity when fired from the firearm, said right cylindrical core having a jacket that is cylindrical and formed from a thermoplastic polymer or copper, said thermoplastic polymer having a softening point above firearm barrel temperatures, and a weight that preferably is at least 80% of a comparable lead bullet, said bullet being capable of being inserted into a firearm and fired therefrom.

In preferred embodiments, the bullet retains markings from the barrel of said firearm.

A further aspect of the invention provides a method for the manufacture of a bullet comprising the steps of:

(a) inserting a right cylindrical shell having one open end into a mold of an injection molding apparatus, said shell being formed from a thermoplastic polymer or copper;

(b) injecting a composition selected from amorphous or low crystallinity polymer into said shell; and (c) removing said bullet so formed from the mold.

The present invention is illustrated by the embodiments shown in the drawings, in which.

Figure 1A:
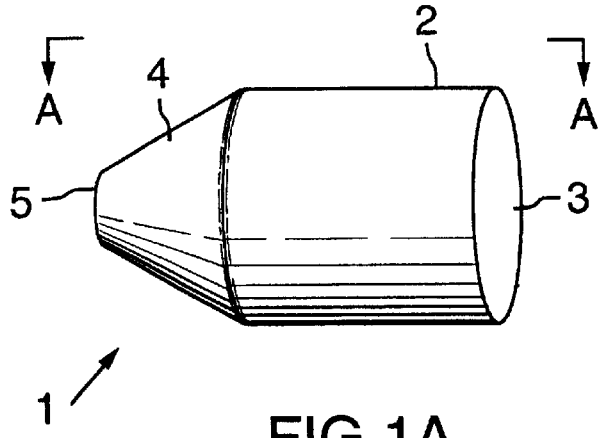
FIG. 1A is a schematic representation of a bullet of the prior art that is formed from a polymer composition.

FIG. 1A shows a bullet of the prior art, generally indicated by 1. Bullet 1 has a core 2 in the shape of a right cylinder. Core 2 has a first end 3 and a second end 4. First end 3 is a right section across the right cylinder of core 2. Second end 4 is a tapered section integrally attached to core 2. The tapered section of second end 4 is shown as being truncated, terminating in a rounded but flat nose 5. It is understood that when purchased, first end 3 of bullet 1 would be inserted in the shell of the bullet cartridge containing the propellant used in the firing of the bullet; the shell is not shown. Nose 5 is the end that impacts the target.

Figure 1B:
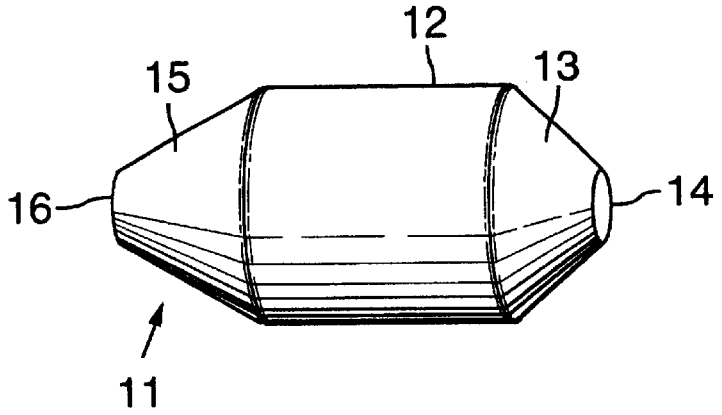
FIG. 1B is a schematic representation of an alternate bullet of the prior art formed from a polymer composition.

FIG. 1B shows a bullet 11 which is a variation on the shape of bullet 1. Bullet 11 has a right cylindrical core 12 that is terminated on one end by truncated tapered section 13 and on the other end by truncated tapered section 15. Tapered section 13 has end 14 that would be in the shell of the cartridge when purchased. Tapered end 15 terminates in nose 16 in the same manner as for bullet 1 of FIG. 1A.

Figure 1C:
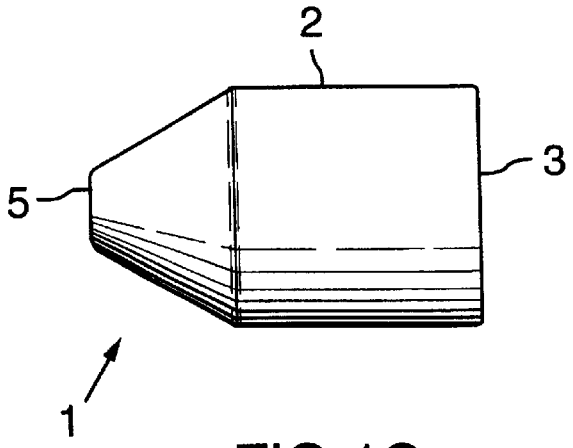
FIG. 1C is a schematic representation of a cross-section through A—A of the bullet of the prior art shown in FIG. 1A.

FIG. 1C shows a cross-section of bullet 1 of FIG. 1A. Bullet 1 has core 2 with first end 3 and nose 5. It will be noted that bullet 1 as shown in FIG. 1C is formed from a uniform composition.

Figure 2A:
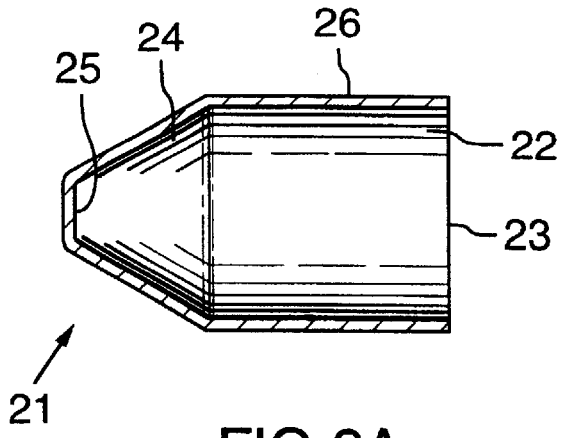
FIG. 2A is a schematic representation of a cross-section of a bullet of the present invention.

FIG. 2A shows a bullet 21 of the invention. Bullet 21 has a core 22 that terminates at one end at end 23 and at the other end at truncated tapered section 24. Tapered section 24 terminates at nose 25. In addition, bullet 21 has jacket 26. Jacket 26 is shown in FIG. 2A as extending the entire length of core 22 and encasing both tapered section 24 and nose 25. Thus, in the embodiment shown in FIG. 2A jacket 26 encloses all of core 22 with the exception of end 23. Jacket 26 is a uniform jacket, especially in cross-section as eccentricity in the jacket would cause wobbling and deflection of the bullet during flight to a target.

Figure 2B:
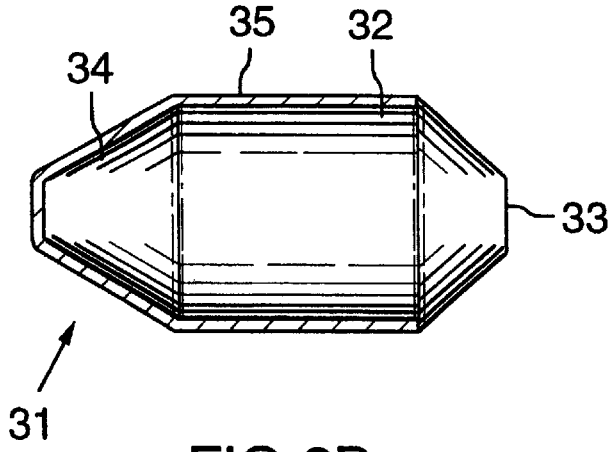
FIG. 2B is a schematic representation of a cross-section of an alternate embodiment of a bullet of the invention.

FIG. 2B shows a variation on bullet 21. In FIG. 2B, bullet 31 has core 32 with truncated tapered section 33 at one end and truncated tapered section 34 at the opposed end. Core 32 and tapered section 34 are enclosed by jacket 35. Truncated tapered section 33 is shown as extending from jacket 35.

Figure 2C:
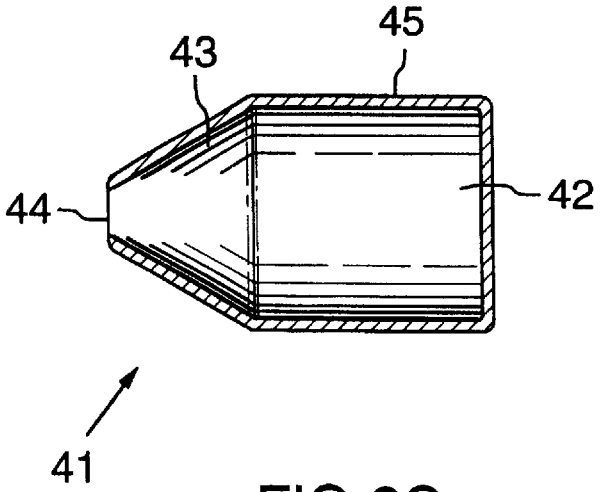
FIGS. 2C, 2D and 2E are schematic representations of further embodiments of a bullet of the invention.
Figure 2D:
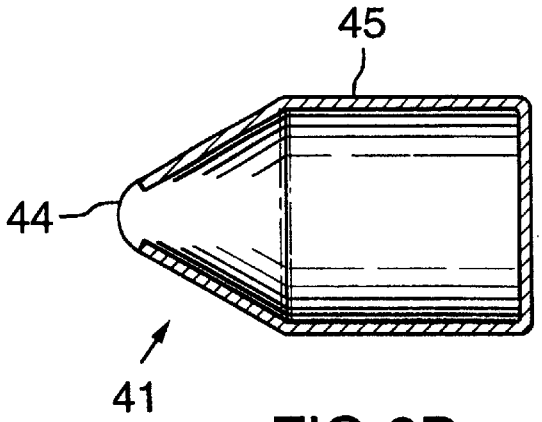
Figure 2E:
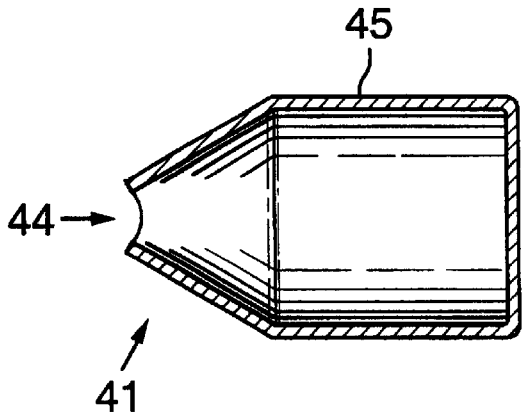

FIG. 2C shows a bullet 41 having a core 42 with truncated tapered section 43 attached thereto that terminates in nose 44. Bullet 41 has jacket 45 thereon. In the embodiment of FIG. 2C, jacket 45 encloses core 42 and tapered section 43, including the rear of core 42, but does not enclose nose 44. Thus nose 44 is open i.e. it is not covered by jacket 45. FIGS. 2D and 2E show bullets that are similar to that of FIG. 2C, except that nose 44 is a rounded nose in FIG. 2D and a hollow-point in FIG. 2E.

FIG. 2A represents a non-frangible bullet i.e. a bullet that does not fragment on impact. FIG. 2C represents a frangible bullet i.e. a bullet that would fragment on impact.

Figure 3:
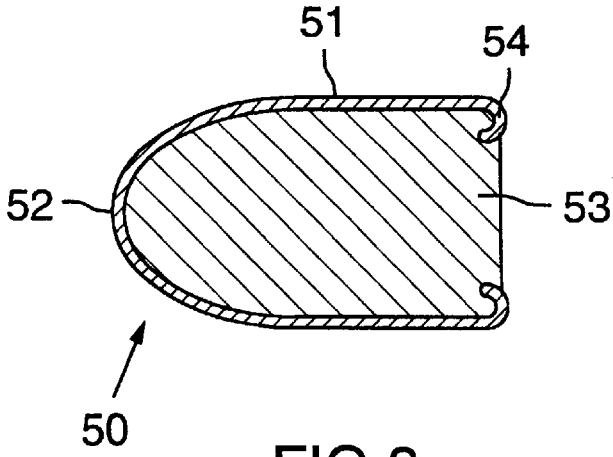
FIG. 3 is a schematic representation of a cross-section of a preferred embodiment of a bullet of the invention.

FIG. 3 shows a bullet, generally indicated by 50, having shell 51. In the embodiment shown, shell 51 has a parabolic tip 52 and is filled with core 53. Shell 51 is characterized by having inwardly curved end 54, that is curved towards the tip. Inwardly curved end 54 retains core 53 in shell 51 on firing of the bullet, and is curved sufficiently to do so. In the absence of a curved end, there is a tendency for the core to separate from the shell on firing of the bullet. It is believed to be not necessary for the curvature to be 180° or more, although the inwardly curved end should be curved more than 90° and especially at least about 150°. FIG. 3 shows the curl to be about 180°.

The core of the bullet may be made from a variety of compositions. As stated above, the composition is lead-free. The composition used for the core must, in combination with the jacket, in preferred embodiments of the invention result in the bullet having a sufficient weight to actuate automatic reloading mechanisms, as discussed above. If the bullet is a frangible bullet, the core must be of a composition that will retain its integrity on firing from the firearm and in travelling from the firearm to the target, but on impact on the target the composition must be frangible i.e. it must fragment.

The core is formed from a polymer composition of a filler and a polymer that is amorphous or is of low crystallinity. In embodiments, the polymer is ethylene/methacrylic acid copolymer ionomer, polyetherester elastomer or polyamide, or blends thereof. A preferred polymer is an ionomer. It is understood that the polymers would have a molecular weight suitable for the intended end-use and associated manufacturing processes.

Examples of ethylene/methacrylic acid copolymer ionomers are ethylene/methacrylic acid copolymers that have been partially neutralized with metal ions such as sodium or zinc. Such polymers are available from E.I. du Pont de Nemours and Company under the trademark Surlyn. It is preferred that the ionomer not be too viscous, for ease of dispersion of filler particles in the composition e.g. have a melt index of at least 5; melt index is measured by the procedure of ASTM 1238. Examples of polyamides include nylon 11, nylon 12, nylon 12/12 and related amorphous or low crystallinity polyamides. The polymer may also be a polyetherester elastomer e.g. an elastomer available from E. I. du Pont de Nemours and Company under the trademark Hytrel. Blends of such polymers or of such polymers with other polymers to provide amorphous or low crystallinity polymers may also be used.

The core will normally contain fillers. Examples of such fillers include particles of tungsten, bismuth, tin, copper and stainless steel. The amount of filler may be varied over a wide range, including up to at least about 80% by weight of filler.

A variety of materials may also be used to form the jacket of the bullet. For instance, the jacket may be formed from copper, nylon 6—6, nylon 6–12, nylon 4–12, flexible nylon, nylon 6 or nylon 11, or nylon filled with impact modifiers. As used herein, flexible nylon refers to compositions of polyamides e.g. nylon 6—6, with copolymers of ethylene, e.g. copolymers of ethylene with (meth)acrylic acid, which may be partially neutralized, and/or copolymers of ethylene with (meth)acrylic esters and monomers copolymerizable therewith, such polymers being characterized by improved flexibility properties compared with the polyamide per se. The jacket may also be formed from high molecular weight polyethylene, ultra high molecular weight polyethylene, polyetherester or other elastomers, polyphenylene sulphide, liquid crystal polymers (LCPs) and ionomers.

It is understood that the polyethylene used to manufacture the jacket may be a cross-linked polyethylene.

Within the requirements to manufacture a bullet of acceptable properties, in particular, a bullet having the required weight characteristics for the particular firearm that is to be used, the core materials, loading materials and jackets may be used in any combination.

The core has a jacket thereon, as described above. Metals may be used to form the jacket, provided that the metals can be formed into the shape of the jacket to permit manufacture in a simple and consistent manner. In addition, it is necessary that the jacket has sufficient hardness so that the jacket does not abrade during passage down the barrel and result in contamination of the barrel.

Alternatively, the jacket may be formed from a polymer. If a polymer is used to form the jacket, the polymer must have a softening point and a melting point that is sufficiently high that melting or sticking of the polymer to the barrel of the firearm will not occur during normal use. Thus, the polymer must be a high melting polymer.

If the bullet is a frangible bullet then there must be sufficient adhesion between the core and the jacket such that the bullet will retain its integrity from the moment of firing within the firearm until impact on the target. However, the adhesion between the core and the jacket should not be so strong as to inhibit fragmentation of the bullet on impact with the target, as this would seriously affect the frangible properties of the bullet.

The jacket is most preferably formed of a material that will be marked during the firing of the bullet and the passage of the bullet down the barrel of the firearm, so that the signature of the firearm is imprinted on the jacket. Moreover, the jacket must retain its integrity to a sufficient extent that the signature of the firearm is retained on the jacket even after impact of the bullet on a target.

In addition to making a record of the signature of the firearm, the jacket will also keep the core in a substantially dry condition, and especially prevent expansion of the core as a result of absorption of moisture. Such protection of the core by the jacket may permit additional core materials to be used that cannot be used effectively with a bullet that does not have a jacket.

If the jacket is formed from a metal, it will have a tendency to retain its integrity on impact to a greater extent than a jacket formed from a polymer. Jackets formed from polymers tend to mushroom or expand on impact, which assists in frangibility of the core of the bullet.

The jacket may be constructed with internal serrations, such that on impact of the bullet with a target, the jacket will split along grooves of the serrations and assist in the frangible properties of the bullet. Such serrations will also assist in fragmentation of the bullet per se.

The jacket may be formed from a metal e.g. copper in a casting or molding process. If the jacket is formed from a thermoplastic polymer, the jacket may be formed in an injection molding process. In doing so, care must be taken to ensure that the jacket is uniform in cross-section as any eccentricity in the jacket will affect the flight properties of the bullet after firing from the firearm. In particular, eccentricity will result in deviation of the bullet from its intended trajectory, resulting in a scatter of bullets about the intended target. Thus, it is preferred that the gate of the mold be along the axis of the bullet or jacket, to lessen the likelihood of shifting of the core in the mold during injection of polymer.

In embodiments of the invention, the bullets have a mass sufficient to actuate firearm reloading mechanisms.

With respect to bullets intended to be fired from a rapid-firing firearm, although it is also applicable to other bullets, it is understood that the bullet may have a jacket formed from copper. Alternatively, some polymer compositions may also provide acceptable properties, especially polymers exhibiting high melting points. It is understood that, when fabricated out of some materials, especially polymers, the jacket may act as an insulator, especially with respect to the core of the bullet, to lessen effects of heat on the core. In addition, the bullet may be reinforced to lessen the likelihood of the bullet breaking up i.e. being frangible, on firing of the firearm.

As will be appreciated by persons skilled in the art, the round that is fed to the firearm will be in the form of a shell casing containing a suitable propellant, with the bullet inserted in the end thereof. The propellant, which may be referred to as a round propellant or a controlled-burn propellant, will have characteristics suitable for effecting the firing of the bullet from the firearm, which properties may vary with the type and caliber of the bullet, the type of firearm, and other characteristics.

It is understood that the core of the bullet may contain coatings, particles or the like that may be used in identifying the source of the bullets. For example, the manufacturer of a core could add a particular compound to the core that could be used to identify that manufacturer's product. Incendiary materials may also be added to the core material, for use in bullets having tracer properties.

The bullets of the present invention are particularly intended to replace conventional lead bullets, or the equivalent thereof. Thus, the bullets would normally have a similar weight of a comparable lead bullet i.e. a lead bullet of the same dimensions. In particular, the bullets have a weight that is at least 80% of the weight of a lead bullet of the same dimensions, referred to herein as a comparable lead bullet, especially at least 85% of such weight.

The bullets of the present invention are lead free, and thus are less hazardous to the environment. In addition, the bullets do not give off fumes of lead when used in, for example, a firing range, and, thus, exhibit less potential health problems. Furthermore, the bullets are such that the signature of the barrel of the firearm is imprinted on the bullet during firing, allowing the tracing of the bullet to the firearm that was used, which is particularly important in law enforcement activities.

The bullets may be formed using an injection process, in which the jackets are placed in a suitable mold for retention of the jacket and the material of the core is injected into the jacket. For core materials that cannot be injected, it is possible to form the core material into a rod e.g. using solid-phase forming techniques, which is then cut into lengths relating to the size of the core.

In a preferred embodiment of the present invention, the bullets are manufactured in a one-step injection molding process. In such a process, a jacket in the form of a right cylindrical shell is inserted into a mold of an injection molding process. One end of the right cylindrical shell is open and the diameter of the shell is slightly less than the required diameter of the bullet; the mold is of a diameter slightly larger than the shell, to permit insertion of the shell into the mold, and of a diameter appropriate for production of bullets of the required diameter. The other end of the right cylindrical shell may be preformed into a desired shape e.g. a parabellum. However, in embodiments the shell fed to the mold is a right cylindrical shell with an open end, the opposed end having rounded corners to facilitate forming into the desired shape in the mold.

The bullets may be formed in at least two ways. For instance, if the bullet is a hollow tipped bullet or otherwise has a tip that is not formed from the shell, then the open end of the right cylindrical shell will be the tip of the bullet. The rear of the bullet would normally be a truncated cone, or other suitable shape, and the mold would have a corresponding shape.

If the bullet has a tip formed from the shell e.g. a rounded or parabolic tip, then the mold would have the corresponding shape. The mold could be adapted to form at least two other shapes at the open end of the shell e.g. a core in the shape of a truncated cone extending from the shell or a right cylindrical shape.

In the injection molding process, for a hollow point bullet, the mold is closed at which time the truncated cone, or other shape, end is formed. The material of the core is injected, which forms the shape of the hollow point and also sizes the jacket to the size of the mold. The bullet so formed is then ejected from the mold.

In the injection molding process, for a bullet with a solid point (tip) it is preferred that the tip be preformed but such preforming could be carried out in the mold prior to injection of the material of the core. The core is then injected and the open end formed into the desired shape. In a preferred embodiment, the open end of the jacket is curled inwards towards the tip, and such curling is carried out by the closing of the mold, after injection of the polymer. The inwardly curled end effectively locks the core into the bullet. In particular, the inwardly curled end prevents the core from separating from the shell on firing of the bullet.

In the absence of the inwardly curled end, there is a tendency for the shell and core to separate, which has significant adverse effects on the trajectory and effectiveness of the bullet.

It is understood that the jacket could be preformed i.e. formed prior to insertion into the mold of the injection molding process, or formed in the mold as part of the injection molding process.

The present invention is illustrated by the following examples.

EXAMPLE I

Bullets substantially as shown in FIG. 2 were prepared from a variety of materials, using laboratory techniques.

Cores of the bullets were formed from epoxy or phenolic resins that were loaded (filled) with tungsten, bismuth or tin, and cores were also prepared from nylon 6–12, flexible nylon, nylon 11 , ethylene/vinyl acetate copolymers and ionomers (available as Surlyn™ ionomer).

Jackets were prepared from copper, nylon 6—6, nylon 6–12, flexible nylon, nylon 6, amorphous nylon, high molecular weight polyethylene and polyetherester elastomer (available as Hytrel™ elastomer).

Bullets made from a variety of combinations of the above cores and jackets were tested by firing a magazine of the bullets from a firearm. The magazine typically contained 10–15 bullets/magazine, depending on the firearm that was used. It was found that at a distance of 25 yards, using a hand-held firearm, the grouping of bullet holes on a target was often less than 3 inches in diameter, indicating that uniform and acceptable bullets had been manufactured and tested. In some instances, greater scatter was observed, which was believed to be due at least in part to the bullets not being not uniform in cross-section, as a result of core shifting during the molding process. Such nonuniformity of the bullets formed in the manufacturing process would result in greater scatter of the bullet on the target.

A preferred bullet had a core of filled ionomer and a copper jacket.

EXAMPLE II

Jacketed bullets having a round (parabellum) tip and with a base with an inwardly curled shell, as described herein, were manufactured on an injection molding process, also as described herein. The jacket was copper and the core was nylon 11 compounded with metallic copper particles.

The bullets were 9 mm. A number of bullets were measured, and found to be 0.681±0.001 inches in length, 0.3543±0.0001 inches in diameter, and with a weight of 88.1±0.4 grams.

The bullets were prepared for firing by being combined with a cartridge, using 5.1 grams of Hercules Bullseye™ powder.

A total of 10 bullets were tested in a Beretta 92F pistol on a firing range. The muzzle velocity of the bullets was determined to be 1301±23 fps. The energy of the bullets ($(\text{velocity})^2 \times \text{weight}$) was 314 ft.lbs.

A high degree of consistency i.e. low scatter was noted from the holes in the target. The bullets were judged to be acceptable, and comparable to lead bullets.

EXAMPLE III

Bullets as described in Example II were prepared for firing using 6.8 grams of Alliant Power Pistol™ powder.

A total of 10 bullets were fired from the Beretta 92F pistol on the firing range. The muzzle velocity was determined to be 1267±27 fps. The energy of the bullets was 314 ft.lbs.

A high degree of consistency was noted from the holes in the target. The bullets were judged to be acceptable.

EXAMPLE IV

Bullets as described in Example II were prepared for firing using 5.1 grains of Hercules Green Dot™ powder.

A total of 10 bullets were fired from the Beretta 92F pistol on the firing range. The muzzle velocity was determined to be 1298±16 fps. The energy of the bullets was 330 ft.lbs.

A high degree of consistency was noted from the holes in the target. The bullets were judged to be acceptable.

EXAMPLE V

Bullets as described in Example II were prepared for firing in a 9 mm Luger pistol. In each test, three slips of 10 rounds each were fired on the test range.

When the powder was Hercules Green Dot powder, the average velocity for the bullets of each clip was 1390, 1389 and 1395 fps. The pressure was 396, 199 and 295 ft.lbs.

When the powder was Hercules Bullseye powder, the average velocity for the bullets of each clip was 1386, 1377 and 1386 fps. The pressure was 291, 288 and 293 ft.lbs.

When the powder was H.S. 700-X, the average velocity for the bullets of each clip was 1402, 1396 and 1932 fps. The pressure was 296, 297 and 291 fts.lbs.

What is claimed is:

1. A bullet that will retain markings from a firearm barrel when fired from such firearm, comprising:

a right cylindrical core with opposed ends, one such opposed end having a tapered section integrally connected thereto, said core being formed from a lead-free composition comprising a filler and a polymer, said polymer being selected from the group consisting of amorphous polymers, low crystallinity polymers and combinations thereof, said composition retaining its integrity when fired from the firearm, said right cylindrical core having a jacket that is cylindrical and formed from a thermoplastic polymer or copper, said thermoplastic polymer having a softening point above firearm barrel temperatures, the adhesion between the jacket and the core being sufficient to retain the integrity of the bullet on firing until impact, said bullet having a weight that is at least 80% that of a comparable bullet for such firearm, said comparable bullet being formed from lead.

2. The bullet of claim 1 in which the weight is at least 85% of the comparable lead bullet.

3. The bullet of claim 1 in which the jacket and core separate on impact.

4. The bullet of claim 1 in which the mass of the bullet is sufficient to actuate firearm reloading mechanisms.

5. The bullet of claim 1 in which the tapered section is a truncated cone or truncated parabellum.

6. The bullet of claim 1 in which the bullet has a tip that is parabolic, rounded or a hollow point.

7. The bullet of claim 1 in which the jacket of the bullet extends over the tapered section attached to one end of the right cylindrical core.

8. The bullet of claim 1 in which the other of the opposed ends is a truncated tapered section.

9. The bullet of claim 1 in which the polymer of the core is an ionomer.

10. The bullet of claim 1 in which the polymer of the core is selected from ethylene/methacrylic acid copolymer ionomers, polyetherester elastomers and polyamides.

11. The bullet of claim 1 in which the polymer of the core is an ethylene/ methacrylic acid copolymer ionomer.

12. The bullet of claim 1 in which the polymer of the core is polyamide.

13. The bullet of claim 1 in which the polyamide is nylon 11.

14. The bullet of claim 1 in which the filler is particles of copper.

15. The bullet of claim 1 in which the filler is selected from the group consisting of tungsten, bismuth, tin and stainless steel.

16. The bullet of claim 1 in which the bullet retains markings from the barrel of said firearm.

17. The bullet of claim 1 in which the jacket at the other of the opposed ends is curled inwards towards the tip.

18. The bullet of claim 17 in which the remainder of said end is free of jacket.

19. The bullet of claim 1 in which the jacket is copper.

20. The bullet of claim 1 in which the jacket is a thermoplastic polymer.

21. A bullet of claim 1 in a shell, said bullet being capable of being inserted into a firearm and fired therefrom.

* * * * *

UNITED STATES PATENT AND TRADEMARK OFFICE

CERTIFICATE OF CORRECTION

PATENT NO. : 6,257,149 B1
DATED : July 10, 2001
INVENTOR(S) : Anthony J. Cesaroni It is certified that error appears in the above-identified patent and that said Letters Patent is hereby corrected as shown below:

Column 7,
Line 54, "In the absence of the inwardly curled end, there is a tendency for the shell and core to separate, which had significant adverse effects on the trajectory and effectiveness of the bullet." is part of the preceding paragraph. It should not start a new paragraph.

Column 10,
Line 20, replace "1" with -- 2 --.

Signed and Sealed this

Eighth Day of October, 2002

*Attest:*

*Attesting Officer*

JAMES E. ROGAN
*Director of the United States Patent and Trademark Office*